US010415754B2

(12) United States Patent
Setlock et al.

(10) Patent No.: US 10,415,754 B2
(45) Date of Patent: Sep. 17, 2019

(54) PRESSURE VESSEL HAVING AN INTERNAL SUPPORT STRUCTURE

(71) Applicant: hyQ Technologies, LLC, Avon Lake, OH (US)

(72) Inventors: Robert Setlock, Avon Lake, OH (US); Neal Birchfield, Prospect, OH (US); Michael Lang, Mason, OH (US); Jacqueline Vance, Pepper Pike, OH (US)

(73) Assignee: hyQ Technologies, LLC, Avon Lake, OH (US)

( * ) Notice: Subject to any disclaimer, the term of this patent is extended or adjusted under 35 U.S.C. 154(b) by 298 days.

(21) Appl. No.: 15/593,480

(22) Filed: May 12, 2017

(65) Prior Publication Data

US 2018/0224065 A1 Aug. 9, 2018

Related U.S. Application Data

(60) Provisional application No. 62/499,942, filed on Feb. 8, 2017.

(51) Int. Cl.

| | |
|---|---|
| ***F17C 1/08*** | (2006.01) |
| ***F17C 1/14*** | (2006.01) |
| ***F17C 1/16*** | (2006.01) |

(52) U.S. Cl.

CPC ..... *F17C 1/08* (2013.01); *F17C 1/14* (2013.01); *F17C 1/16* (2013.01); *F17C 2201/0147* (2013.01); *F17C 2201/0157* (2013.01); *F17C 2201/054* (2013.01); *F17C 2201/056* (2013.01); *F17C 2201/058* (2013.01); *F17C 2203/012* (2013.01); *F17C 2203/013* (2013.01);

(Continued)

(58) Field of Classification Search

CPC ..... F17C 1/08; F17C 1/14; F17C 1/16; F17C 2203/013; F17C 2260/011; F17C 2201/0147; F17C 2201/0157; F17C 2201/054; F17C 2201/056; F17C 2201/058; F17C 2203/012; F17C 2203/0619; F17C 2203/0636; F17C 2203/066; F17C 2203/0663; F17C 2221/031; F17C 2221/035; F17C 2223/0123; F17C 2223/0153; F17C 2223/035; F17C 2260/012; F17C 2270/0545; F17C 2270/0745; F17C 2270/0781

See application file for complete search history.

(56) References Cited

FOREIGN PATENT DOCUMENTS

| | | |
|---|---|---|
| WO | 9727105 A1 | 7/1997 |
| WO | 0008375 A1 | 2/2000 |

OTHER PUBLICATIONS

Setlock, Robert J., Jr., Hydrostatic Pressure Retainment, thesis, Jun. 2004, 107 pgs., Director of Thesis Bhavin V. Mehta, USA.

*Primary Examiner* — Michael C Miggins
(74) *Attorney, Agent, or Firm* — Standley Law Group LLP

(57) ABSTRACT

A pressure vessel for containing a pressurized fluid is disclosed. An outer shell may define a cavity where the fluid is stored. An inner matrix substantially fills the cavity and undertakes a majority of the forces exerted by the stored fluid. The inner matrix is a series of interconnected nodes with a series of voids located therebetween. The voids contact one another so that fluid may flow therebetween, thus filling the cavity. The interconnected nodes are filleted at the points of contact to reduce stress concentrations. An inlet/outlet device may selectively permit the introduction and removal of the fluid from the cavity.

20 Claims, 12 Drawing Sheets

(52) U.S. Cl.
CPC ..... *F17C 2203/066* (2013.01); *F17C 2203/0619* (2013.01); *F17C 2203/0636* (2013.01); *F17C 2203/0663* (2013.01); *F17C 2221/031* (2013.01); *F17C 2221/035* (2013.01); *F17C 2223/0123* (2013.01); *F17C 2223/0153* (2013.01); *F17C 2223/035* (2013.01); *F17C 2260/011* (2013.01); *F17C 2260/012* (2013.01); *F17C 2270/0545* (2013.01); *F17C 2270/0745* (2013.01); *F17C 2270/0781* (2013.01)

PRESSURE VESSEL HAVING AN INTERNAL SUPPORT STRUCTURE

CROSS-REFERENCE TO RELATED APPLICATION

This application claims priority to U.S. Provisional Patent Application Ser. No. 62/499,942 filed Feb. 8, 2017, the disclosures of which are hereby incorporated by reference in their entirety.

TECHNICAL FIELD

Exemplary embodiments of the present invention relate generally to pressure vessels.

BACKGROUND AND SUMMARY OF THE INVENTION

Pressure vessels have been used to store various types of fluids under various levels of pressurization in order to achieve a number of useful ends. Some common examples and applications include, without limitation, power washers, propane tanks, pneumatic tools, scuba tanks, fire extinguishers, pesticide sprayers, and the like. The market has increasingly demanded lighter weight pressure vessels capable of holding fluids under a higher level of pressure. Lighter weight pressure vessels are generally easier to handle and transport. Further, higher pressure fluids generally translate to greater potential energy. Stated simply, the higher the pressure of the fluid in the vessel, the more work that can be done from a single tank.

Traditional pressure vessels have necessarily been spherically or cylindrically shaped to withstand the stresses created by pressurization. Pressurized fluids exert hydrostatic forces (i.e., substantially the same in all directions), so spherical or cylindrical shaped tanks have provided a means for storing such fluids efficiently because the curved surfaces reduce the number of potential stress concentrations that would otherwise be present. However, spherical or cylindrical shaped pressure vessels do not necessarily make efficient use of available space.

Other known pressure vessels have been designed into non-spherical or non-cylindrical shapes, though such pressure vessels require the use of complex internal supports to facilitate their external shape. Such supports must be configured to the particular shape of the vessel and thus are difficult and costly to manufacture. Further, such internal supports often result in significantly increased weight.

Regardless, to provide a factor of safety, the outer shells of traditional pressure vessels (spherical, cylindrical, or otherwise) are generally made with a higher thickness based on a factor of safety over the weakest area of the pressure vessel. Additionally, traditional pressure vessels often fail in a catastrophic manner, which can cause significant damage and injury. Therefore, what is needed is a pressure vessel capable of being formed into various shapes that is relatively easy to manufacture, is relatively low weight, and fails in a graceful manner.

The present invention is a pressure vessel capable of being formed into various shapes that is relatively easy to manufacture, is relatively low weight, and fails in a graceful manner. The present invention is a pressure vessel comprising an inner matrix placed within an outer shell. The outer shell and the inner matrix may be configured to receive a fluid via an inlet/outlet device. The inlet/outlet device may permit the selective introduction and/or release of the fluid and may be configured to receive a number of adapters configured to facilitate the selective introduction and release of the fluid. In exemplary embodiments, separate inlet/outlet device may be used for the introduction and release of the fluid respectively.

Regardless, the inner matrix may substantially fill the outer shell and may comprise a series of substantially spherical voids. Said voids may be inter connected so as to create apertures at their respective points of contact such that fluid may travel between the voids. This may create passageways through the inner matrix for the fluid to travel from the inlet/outlet device and fill the entire pressure vessel. In exemplary embodiments, the voids are arranged in a face centered cubic configuration to form a nearly closed cell lattice where the apertures comprise filleted edges to reduce or eliminate stress concentrations. The inner matrix and outer shell may be comprised of various materials, however, in exemplary embodiments the inner matrix is integrally formed with the outer shell and both are comprised of the same material. 3-D printing may be used to integrally form the inner matrix with the outer shell.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Figure 1:
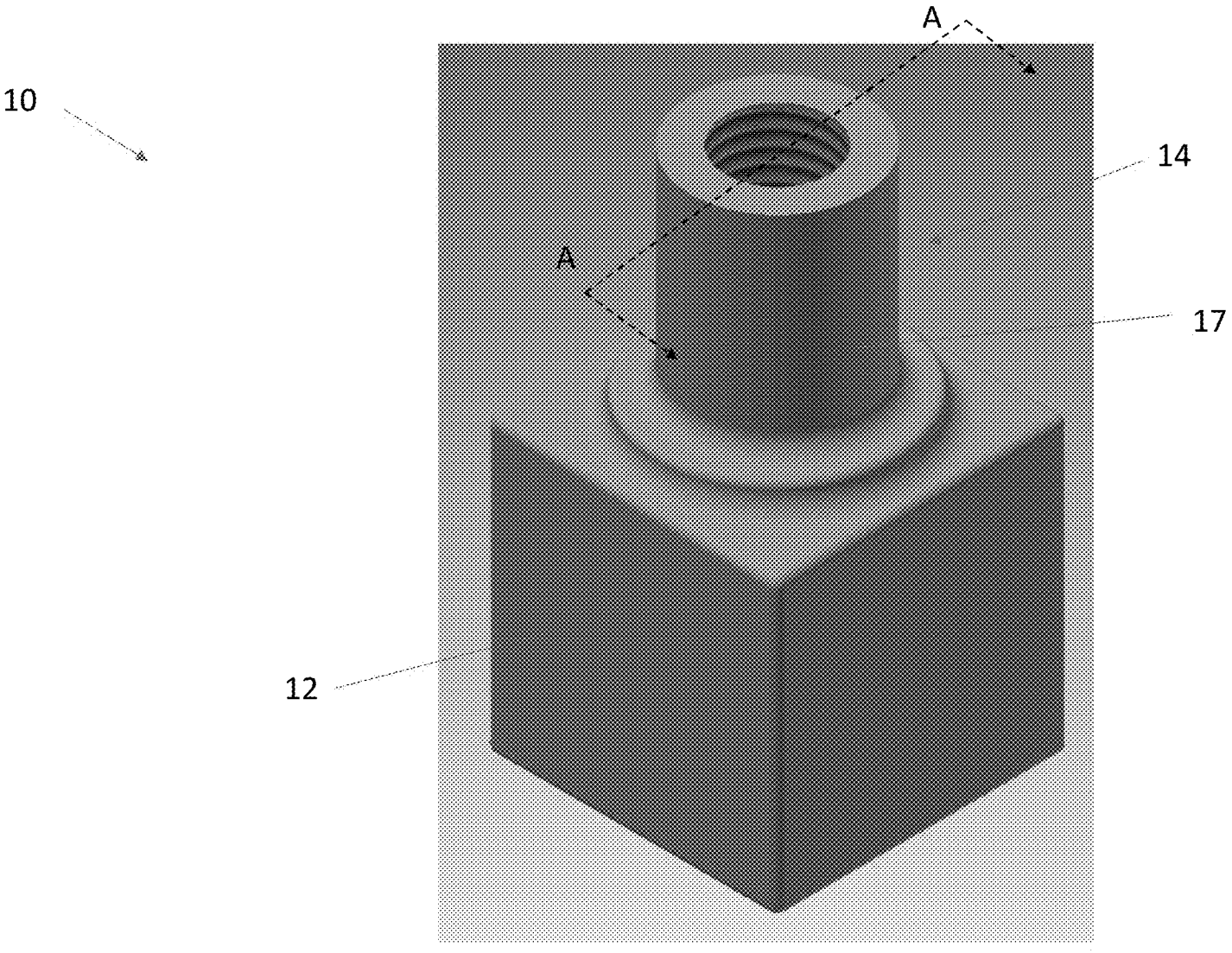
FIG. 1 is a perspective view of any exemplary pressure vessel in accordance with the present invention, also indicating section line A-A.

FIG. 1 is a front perspective view of any exemplary pressure vessel 10 in accordance with the present invention. The pressure vessel 10 may comprise an outer shell 12. As will be described in greater detail here, an inner matrix 22 may be located within the outer shell 12. The outer shell 12 may have external and internal surfaces. The internal surfaces of the outer shell 12 may define a cavity which is substantially sealed and configured to accommodate the storage of various fluids. It is contemplated that the outer shell 12, and the complete pressure vessel 10, may be of any size or shape and may be configured for use in any application. The ability to use various shaped outer shells 12 may allow the pressure vessel 10 to maximize available space as compared to traditional designs which generally require spherical or cylindrical shaped outer shells 12. The thickness of the outer shell 12 may be determined, at least in part, based on the anticipate pressure of the fluid to be stored therein as well as the properties of the inner matrix 22.

The pressure vessel 10 may further comprise an inlet/outlet device 14. The inlet/outlet device 14 may extend through the outer shell 12 such that fluids may be moved into and out of the outer shell 12. The pressure vessel 10 may comprise separate (or multiple) inlet/outlet devices 14 for filling and discharging fluids, though in other exemplary embodiments the same inlet/outlet devices 14 may be utilized for both filling and discharging fluids. One or more of the inlet/outlet device 14 may be configured to be attached to a hose or another device to facilitate cleaning of the interior of the pressure vessel 10. In exemplary embodiments, a first and second inlet/outlet device 14 are configured to facilitate post production washing of the cavity.

Figure 2A:
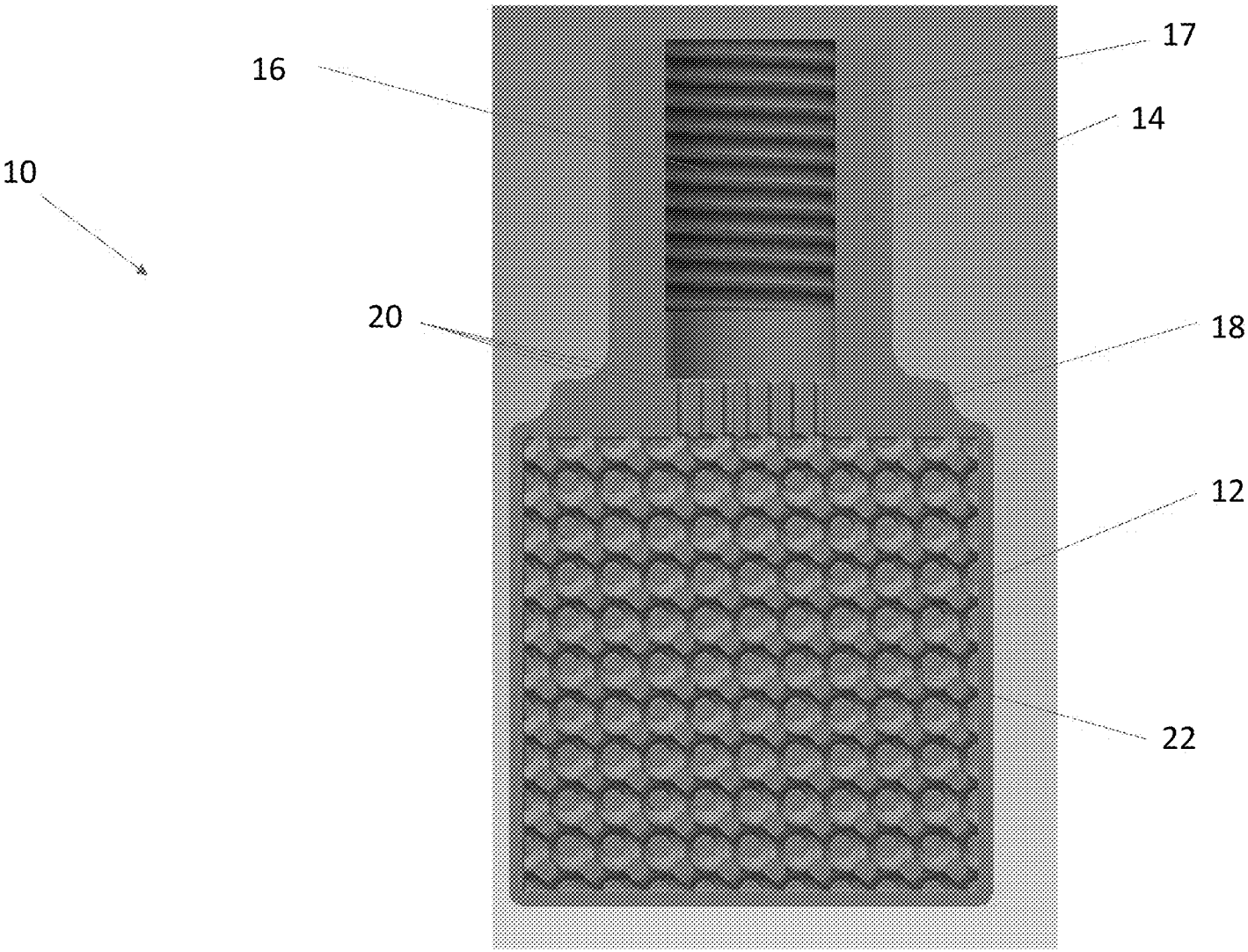
FIG. 2A is a front sectional view taken along section line A-A of FIG. 1.
Figure 2B:
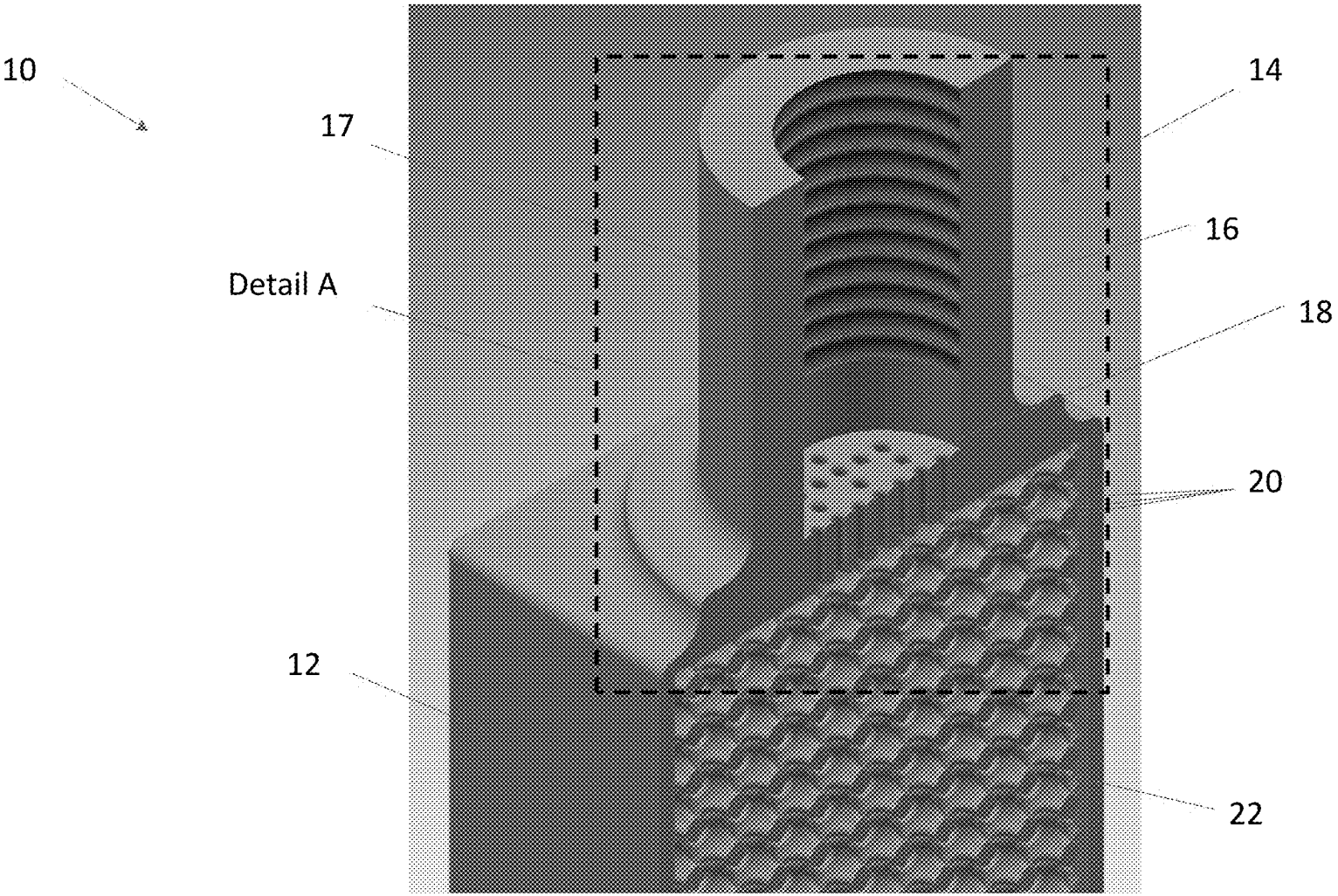
FIG. 2B is top perspective view of section of FIG. 2A, also indicating detail A.
Figure 2C:
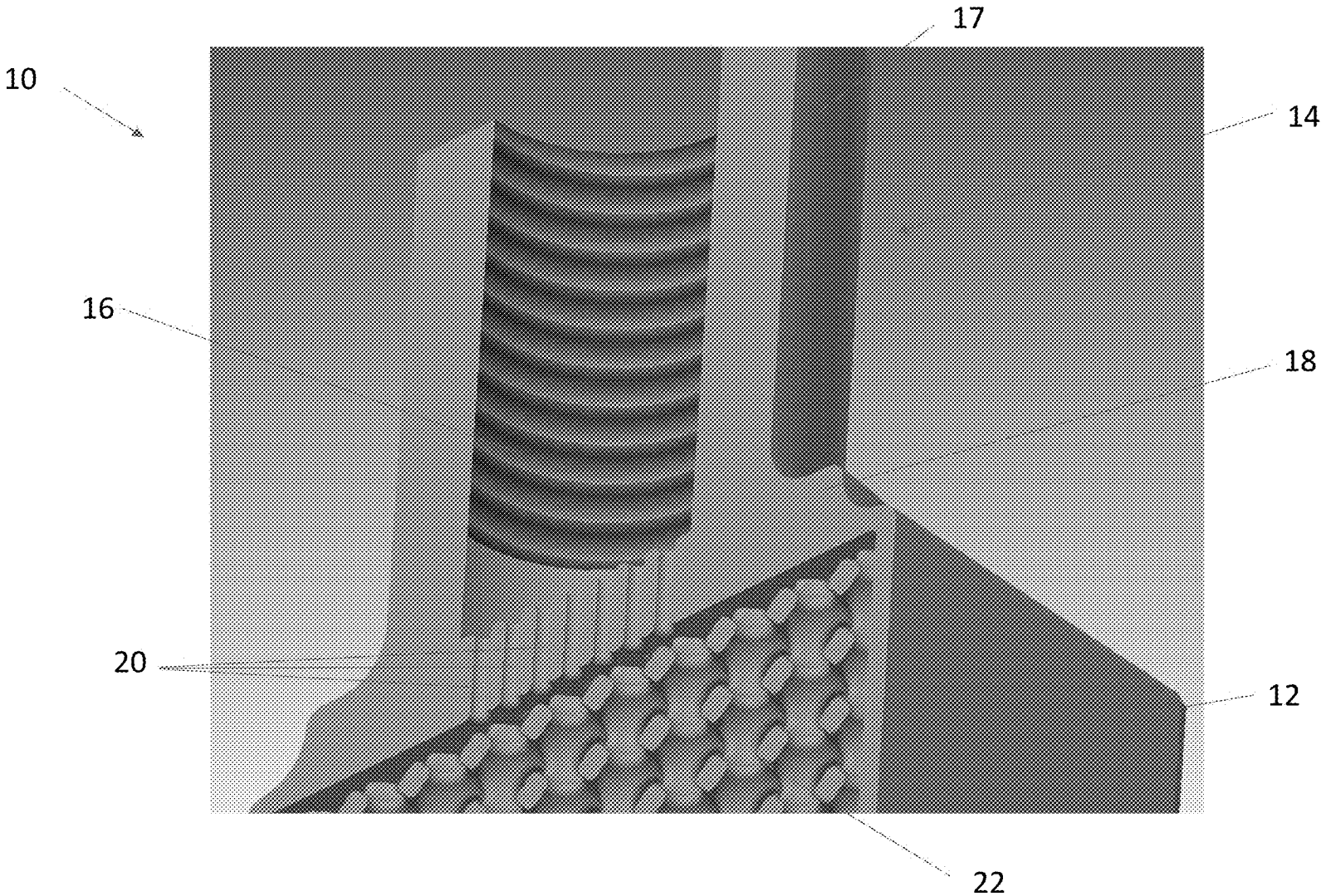
FIG. 2C is a detailed bottom perspective view of Detail A of FIG. 2B.
Figure 2D:
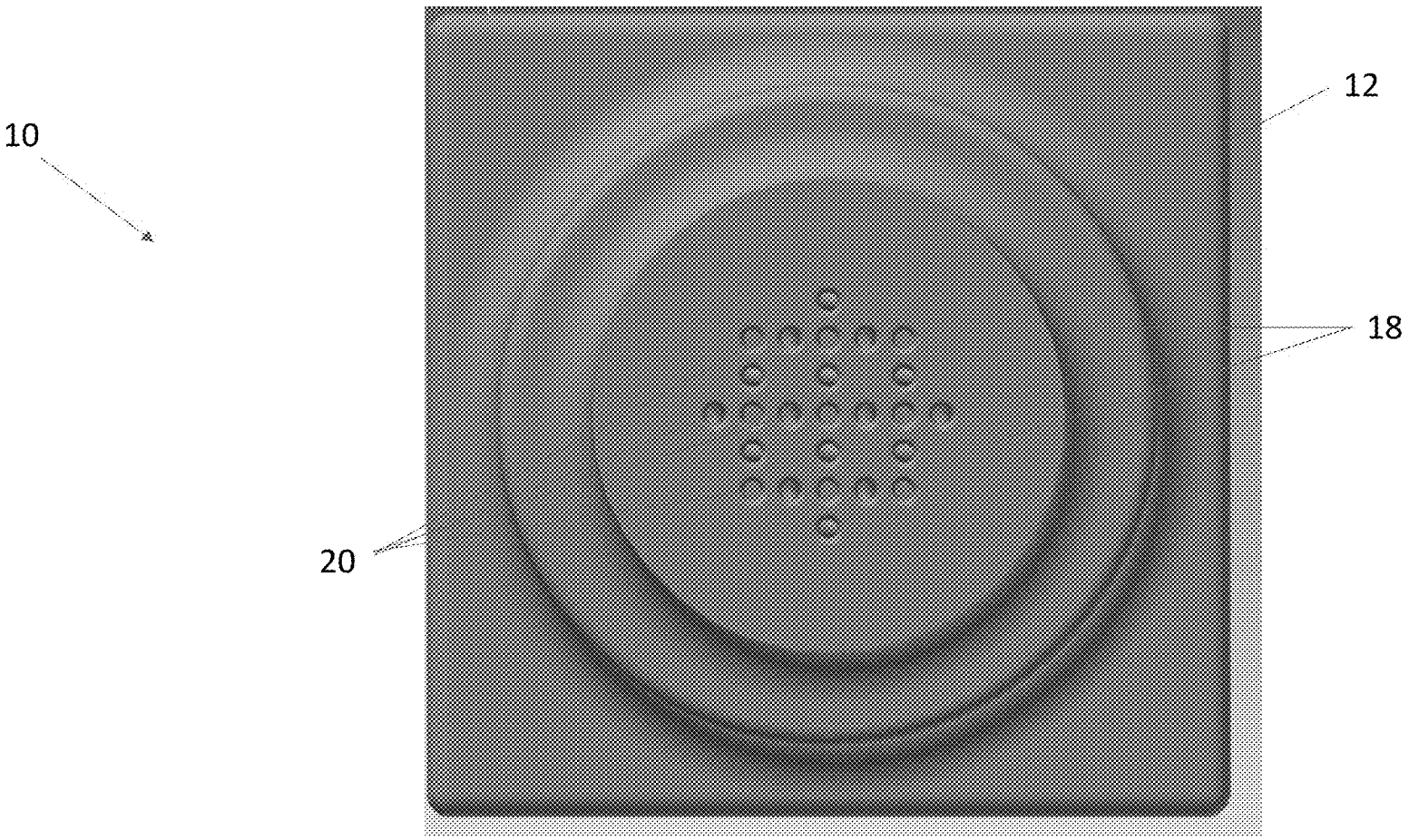
FIG. 2D is a top view of pressure vessel of FIG. 1.

FIG. 2A through FIG. 2D illustrate various views of the device of FIG. 1. FIGS. 2A through FIG. 2C illustrate sectional views where the inner matrix 22 is visible. Although the inner matrix 22 is illustrated as filling the entirety of the cavity, it is contemplated that the inner matrix 22 may fill any portion thereof. The inner matrix 22 may be any matrix, grid, or generally repeating structure comprised of any material.

In exemplary embodiments, the inner matrix 22 may have a density between 2%-55%, thus leaving between 45%-98% of the cavity to be used for the storage of the fluid. The inner matrix 22 may be configured to undertake a portion, a majority, or substantially all of the forces exerted by the fluids stored in the pressure vessel 10. This may reduce, or substantially eliminate, stresses on the outer shell 12 of the exemplary pressure vessel 10.

This stands in sharp contrast to traditional pressure vessels whose outer shell is generally configured to absorb the entirety, or substantially all, of the forces exerted by the fluids stored therein. Such traditional pressure vessels generally require a thick outer shell which is typically placed under significant stress. In contrast, the pressure vessel 10 and the inner matrix 22 of the present invention may allow the outer shell 12 to be thinner. Such a configuration may additionally allow the pressure vessel 10 to fail in a graceful manner. Because the outer shell 12 of the exemplary pressure vessel 10 does not carry as much force as the outer shell of a traditional pressure vessel, a failure in the inner matrix 22 and/or the outer shell 12 of the present pressure vessel 10 will result in a relatively less forceful rupture as compared the outer shell of a traditional pressure vessel.

The inner matrix 22 and the outer shell 12 may be comprised of the same or different materials. In exemplary embodiments, the inner matrix 22 and/or the outer shell 12 may be a lattice structure. The inner matrix 22 and/or the outer shell 12 may be comprised of a substantially homogenous material having isotropic qualities, however, in other exemplary embodiments the inner matrix 22 and/or the outer shell 12 may be comprised of a composite or otherwise non-homogenous material. The inner matrix 22 and/or the outer shell 12 may be comprised of an advanced high strength or reinforced composite or polymers or a metal, though any material is contemplated. Regardless, the structure, size, shape, qualities, and configuration of the inner matrix 22 and/or the outer shell 12 may be the same or may vary.

The inlet/outlet device 14 may comprise a passageway 17 that may extend from any part of the outer shell 12. The passageway 17 may be substantially cylindrical in shape, though any shape is contemplated. The inlet/outlet device 14 may comprise a coupler 16 for securing adapters and various other devices to the inlet/outlet device 14. In exemplary embodiments, the coupler 16 may comprise a series of threads located in the passageway 17, through any type of coupler is contemplated. The coupler 16 may be configured to receive a number of adapters configured to facilitate the selective introduction, release, or transportation of the fluid.

The inlet/outlet device 14 may be configured to minimize or eliminate any disturbances to the stress field flowing throughout the inner matrix 22. The inlet/outlet device 14 may further comprise a cap 18 which extends between the passageway 17 and opening in the outer shell 12. The cap 18 may provide additional thickness, and thus strength, to the outer shell 12 where it is so attached. The cap 18 may comprise a number of holes 20 that pass through the cap and provide a pathway for fluids to travel into and out of the pressure vessel 10. Any number of holes 20 may be located in any pattern (or lack thereof) on the cap 18. However, in exemplary embodiments the number and location of the holes 20 is selected so as to not interfere with the inner matrix 22.

Figure 3C:
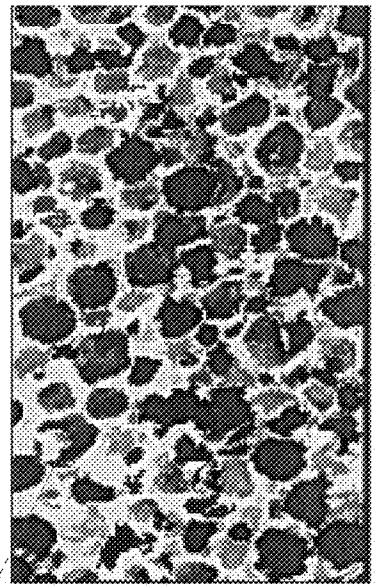
FIG. 3C is a perspective view of another exemplary inner matrix in accordance with the present invention.
Figure 3B:
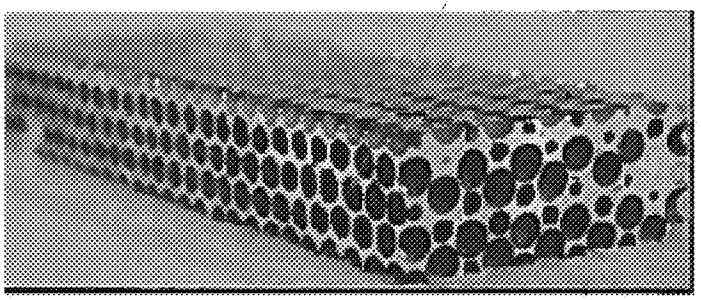
FIG. 3B is a perspective view of another exemplary inner matrix in accordance with the present invention.
Figure 3A:
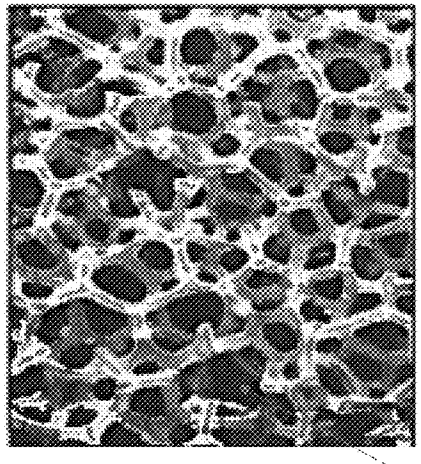
FIG. 3A is a perspective view of an exemplary inner matrix in accordance with the present invention

FIGS. 3A-3C illustrate various exemplary inner matrix 22 microstructures. More specifically, FIG. 3A illustrates an open cell lattice microstructure, FIG. 3B illustrates a closed cell lattice microstructure, and FIG. 3C illustrates a nearly closed cell lattice microstructure.

The inner matrix 22 may comprise a series of voids 24, as will be explained in greater detail herein. The use of open cell lattice microstructures, such as the embodiment illustrated in FIG. 3A, may result in larger and less uniform voids 24. This may result in thinner connecting members similar to wires or fibers. The use of nearly closed cell lattice microstructure, such as the embodiment illustrated in FIG. 3C, may result in smaller and less uniform voids 24. This may result in a structure capable of withstanding greater stresses. The use of closed cell lattice microstructure, such as the embodiment illustrated in FIG. 3B, may result in a more uniform distribution of voids 24. This may provide for more uniform loading. As the maximum pressure rating for pressure vessels 10 is often based on a factor of safety above the lowest yield rating, the uniform loading may permit a higher-pressure rating as compared to an inner matrix 22 having various yield strengths.

Figure 4A:
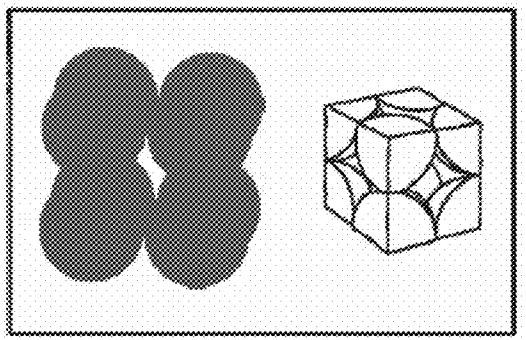
FIG. 4A is a perspective view of an exemplary void arrangement in accordance with the present invention.
Figure 4B:
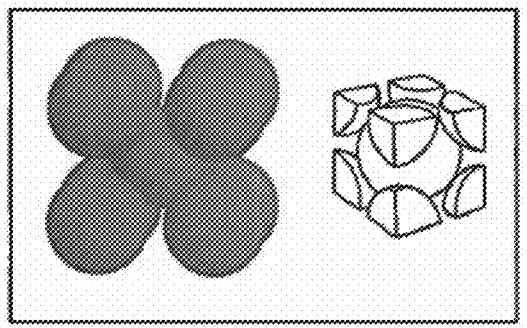
FIG. 4B is a perspective view of another exemplary void arrangement in accordance with the present invention.
Figure 4C:
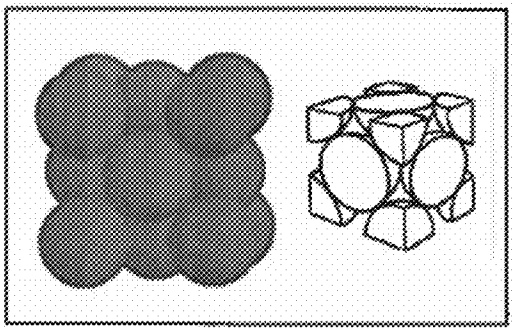
FIG. 4C is a perspective view of another exemplary void arrangement in accordance with the present invention.

FIG. 4A-4C illustrate various void 24 configurations that may be used with the present invention. More specifically, FIG. 4A illustrates a simple cubic structure, FIG. 4B illustrates a body centered cubic structure, and FIG. 4C illustrates a face centered cubic structure. In these illustrated embodiments, the solid materials represent potential voids 24, so the open space represents the potential inner matrix 22. The simple cubic arrangement may provide less open space for fluid storage, but may increase the amount of inner matrix 22 material available to provide structural support. Similarly, the body centered cubic design may increase the amount of open space for fluid storage, but may decrease the amount of inner matrix 22 material available to provide structural support. Similar still, the face centered cubic arrangement may further increase the amount of open space available for fluid storage, but may further decrease the amount of inner matrix 22 material available to provide structural support. The aforementioned arrangements are merely exemplary. Those having skill in the arts will recognize that any arrangement may be utilized with the present invention by itself or in combination with other arrangements.

Figure 5:
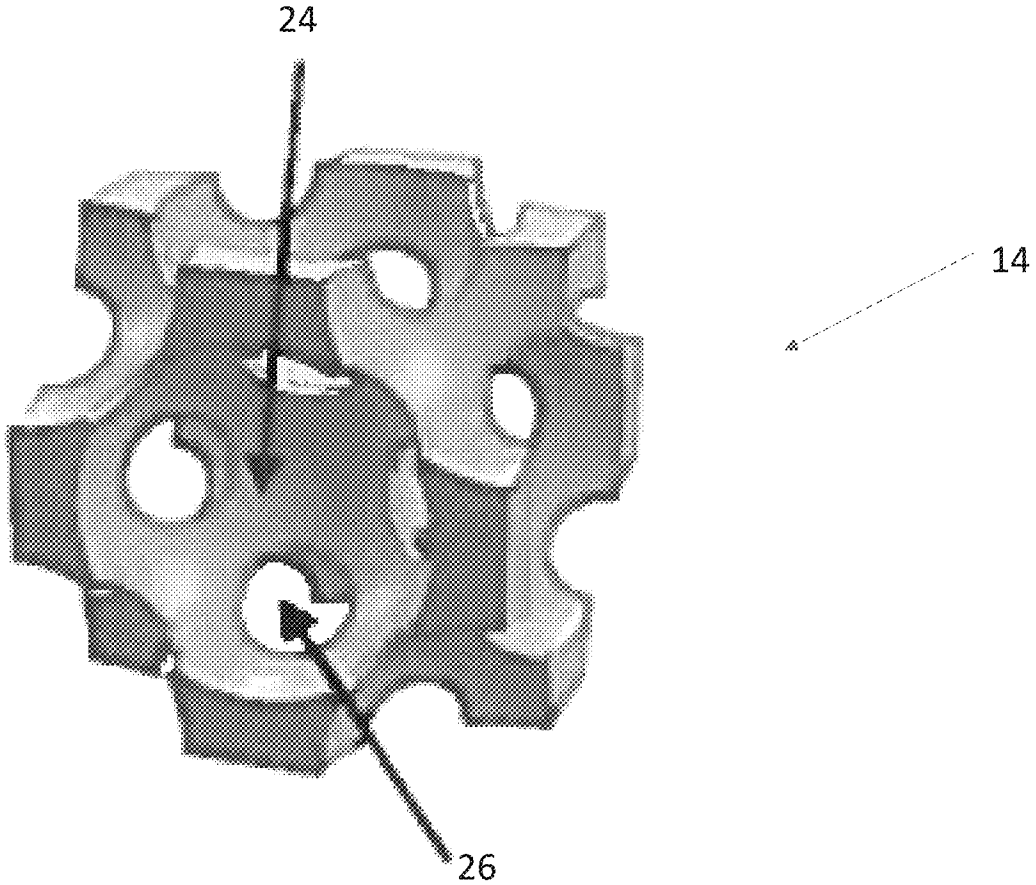
FIG. 5 is a detailed view of an exemplary inner matrix.

FIG. 5 is a detailed view of an exemplary inner matrix 22. The inner matrix 22 may be comprised of the series of voids 24. In exemplary embodiments, the voids 24 are substantially spherical in shape though any shape is contemplated. The voids 24 may intersect one another at various points of contact, thereby forming apertures 26. The apertures 26 may be substantially circular in shape due to the substantially spherical shape of the voids 24. The apertures 26 may permit fluid to move between the voids 24, thus allowing the fluid to substantially fill the pressure vessel 10. This arrangement may permit the forces exerted by the fluid to be more evenly distributed across the inner matrix 22 as well as the outer shell 12. As previously discussed, the size, location, and shape of the voids 24 may vary, and thus the size, locations, and shape of the apertures 26 may likewise vary.

Figure 6:
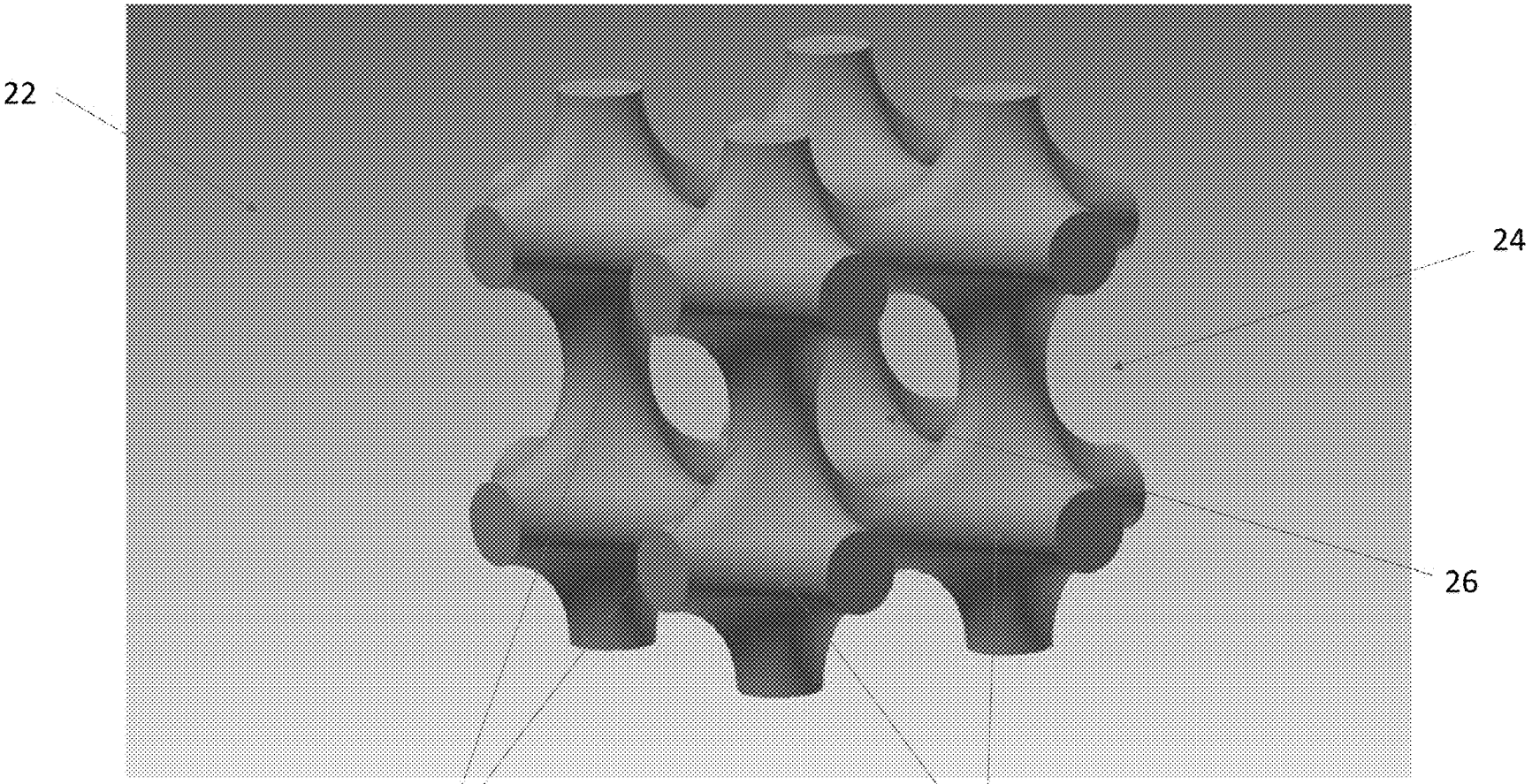
FIG. 6 is a detailed view of another exemplary inner matrix.

FIG. 6 is a detailed view of another exemplary inner matrix 22. In this embodiment, the voids 24 may be increased in size relative to FIG. 5 such that the apertures 26 are enlarged and the available volume to hold fluid is increased. Furthermore, the edges around the apertures 26 may be filleted in a substantially convex shape and smoothed to reduce or substantially eliminate stress concentrations. Stated another way, the remaining inner matrix 22 material may be substantially concave in shape after fileting the edges around the apertures 26. The shape of the inner matrix 22 may alternatively be described by the mass removed from an otherwise solid cube.

Described thusly, the inner matrix 22 may be described as an otherwise solid cube having substantially spherical voids 24 removed therefrom in a face centered cubic arrangement wherein then the edges of said voids 24 are filleted into a substantially concave shape and smoothed. Such an arrangement may result in a series of nodes 28 each being subjected to a substantially tri-axial loading condition resulting in minimized distortion and minimized internal shear stress. Each of said nodes 28 may connect to one another at the top, bottom, front, back, right, and left sides of the nodes 28, thus forming the inner matrix 22. In exemplary embodiments, the same sized and shaped nodes 28 are repeated across the inner matrix 22 forming a matrix that substantially fills the interior of the pressure vessel 10.

In exemplary embodiments, the inner matrix 22 may comprise a series of nodes 28 formed by the intersection of a series of interconnected substantially cylindrical shaped members 25. Each node 28 may be formed by the intersection of three substantially cylindrical shaped members 25, though in other exemplary embodiments each node 28 may be formed by the intersection of any number of the substantially cylindrical shaped member 25. The substantially cylindrical shaped members 25 may be subjected to substantially tri-axial loading condition resulting in minimized distortion and minimized internal shear stress. The edges of the substantially cylindrical shaped members 25 located between said nodes 28 may be filleted into a substantially concave shape and smoothed to reduce or substantially eliminate stress concentrations. This pattern may be repeated across the inner matrix 22 forming a matrix that substantially fills the interior of the pressure vessel 10.

Figure 7B:
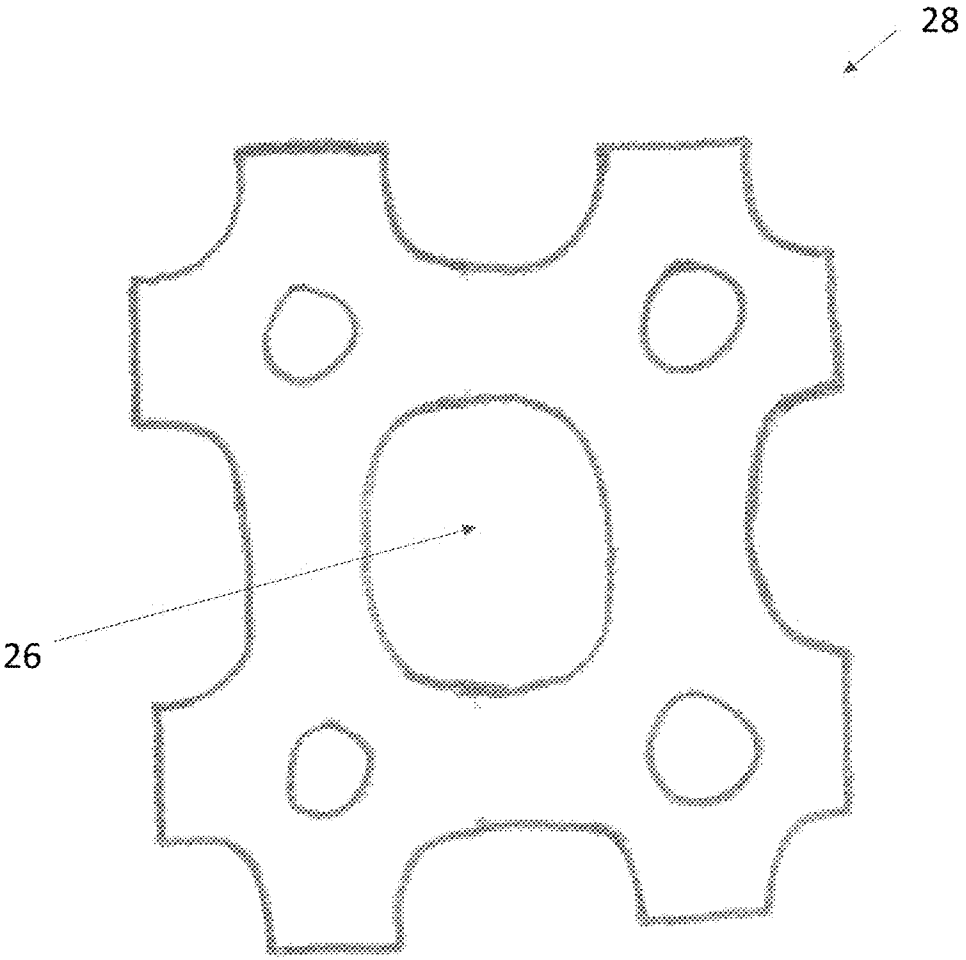
FIG. 7B is a front, top, and side view of four interconnected exemplary nodes from FIG. 7A.
Figure 7A:
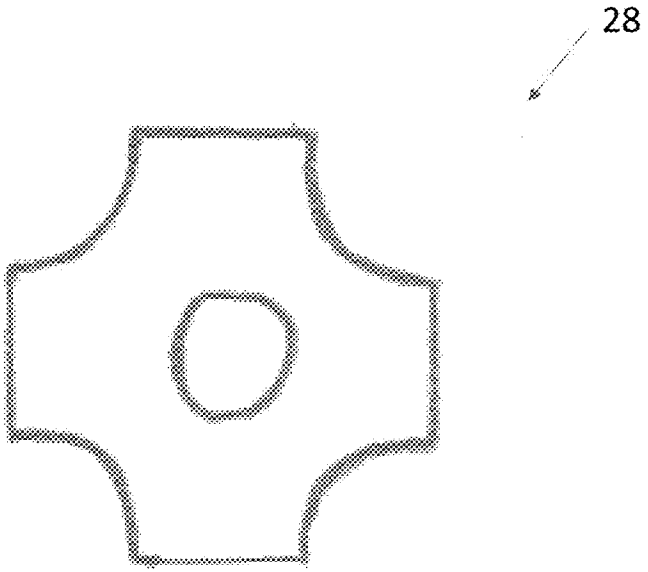
FIG. 7A is a front, top, and side view of an exemplary node for the inner matrix of FIG. 6.

FIG. 7A illustrates an exemplary node 28 and FIG. 7B illustrates four such exemplary nodes 28 interconnected. FIG. 7A and FIG. 7B illustrate a front, top, and side view of the nodes 28 as the nodes 28 are substantially symmetrical. Eight nodes 28 may be interconnected in a substantially rectangular or square arrangement, thus resulting in a single void 24 located in the center thereof. Apertures 26 may connect the voids 24 to adjacent voids 24. In this way, fluid may travel through the inner matrix 22 and be distributed substantially evenly through the pressure vessel 10. This may permit substantially uniform loading of the inner matrix 22 as well as the outer shell 12 of the pressure vessel 10.

Where the inner matrix 22 approaches the inner walls of the outer shell 12, the nodes 28 may be attached to the outer shell 12. In exemplary embodiments, the outer shell 12 and the inner matrix 22 are integrally formed. Exemplary manufacturing techniques for such embodiments include the use of 3-D printing, though any manufacturing technique is contemplated. In other exemplary embodiments, the inner matrix 22 may be a foam material that is placed inside the outer shell 12 and permitted to expand and solidify.

Figure 8A:
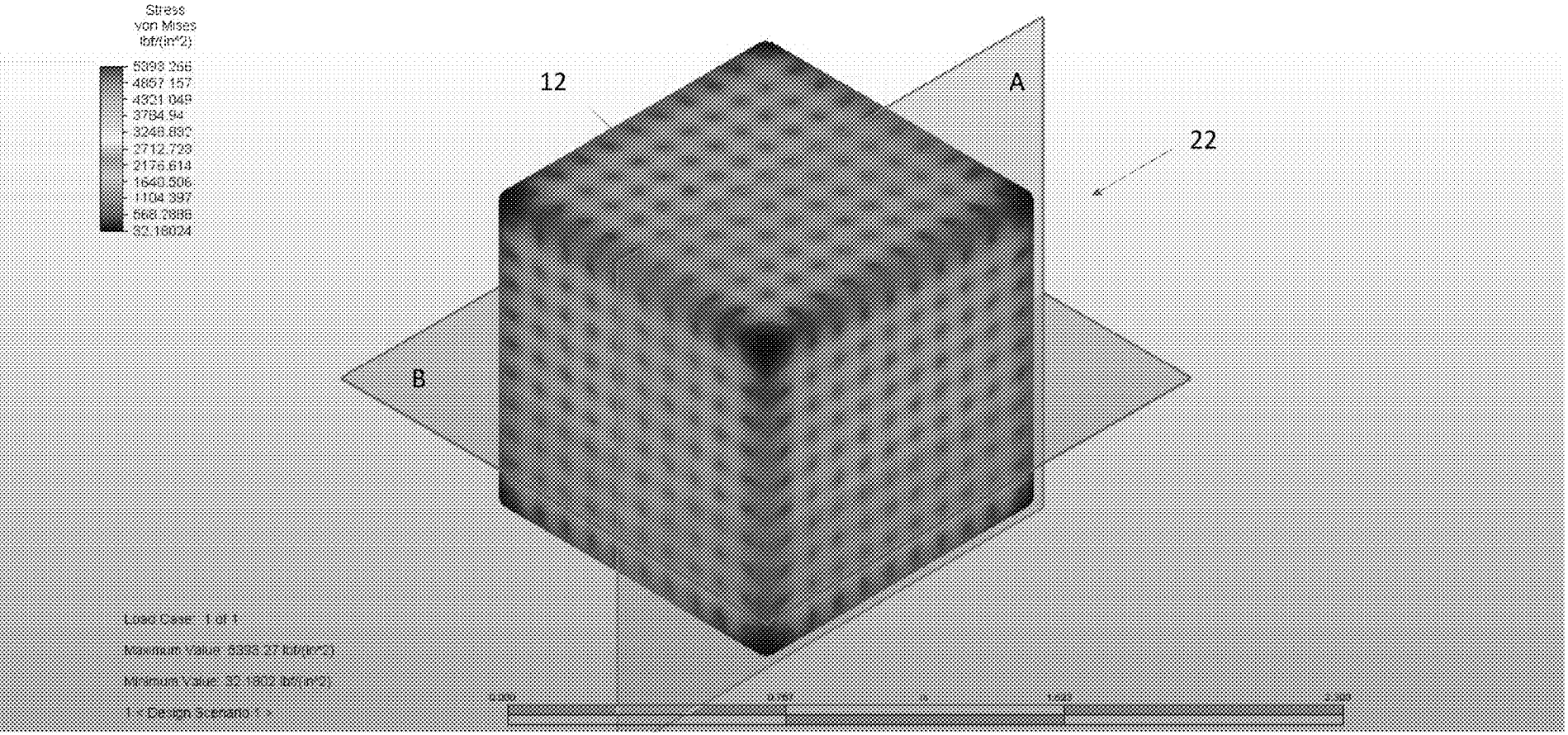
FIG. 8A is a perspective view of an exemplary stress analysis of an exemplary pressure vessel, also indicating section planes A and B.
Figure 8B:
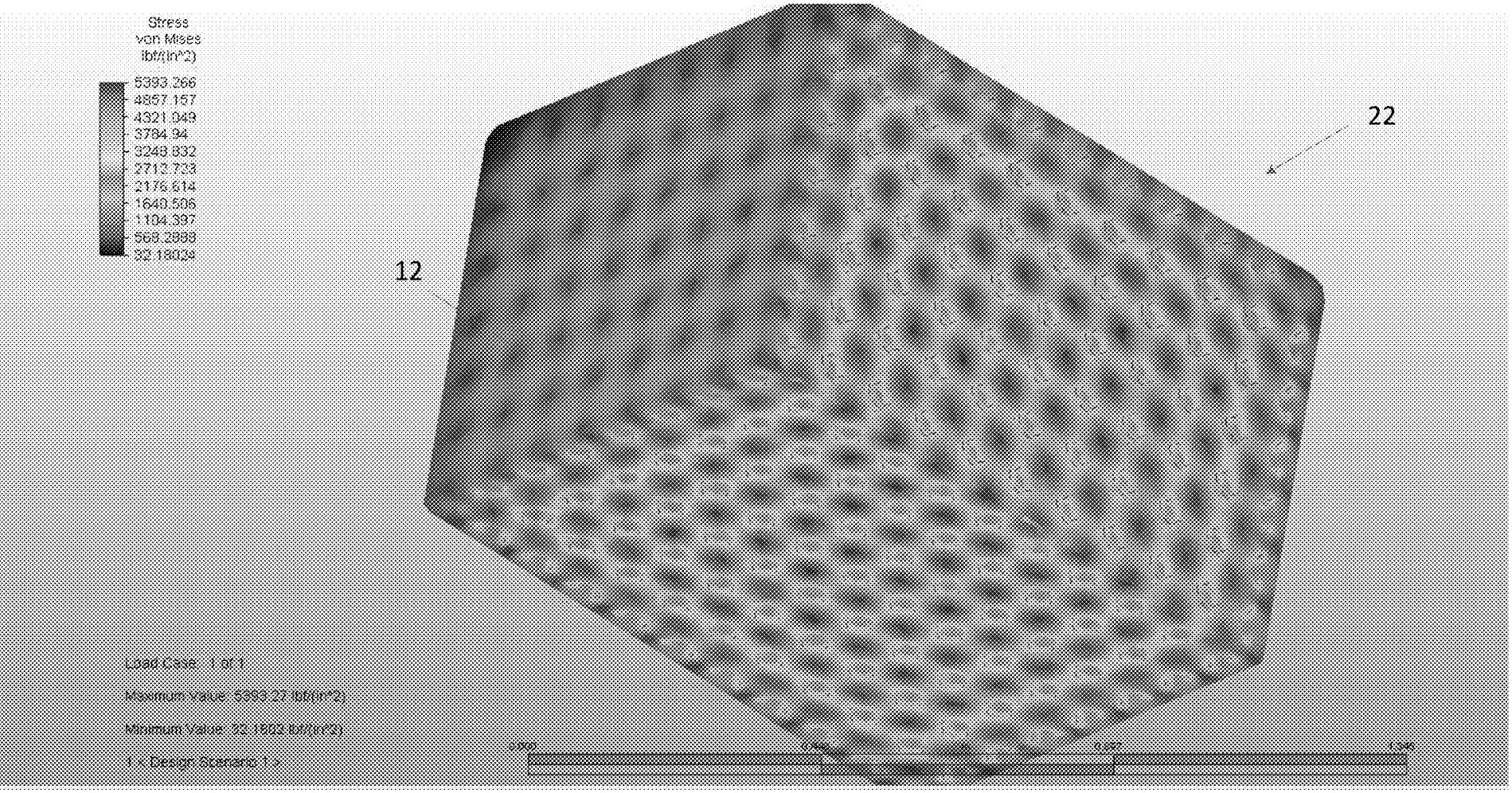
FIG. 8B is a perspective view of the stress analysis of FIG. 8A taken along section planes A and B.

FIG. 8A and FIG. 8B illustrate an exemplary stress analysis of the inner matrix 22 of FIGS. 1-2*d* and 6-7*b*. This analysis is merely exemplary. As can be seen, the stress is relatively evenly spread across the inner matrix 22. This may also minimize angular distortion.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A pressure vessel apparatus for containing a fluid under pressure comprising:

an outer shell which defines a cavity and is configured to contain the fluid;

an inner matrix located within the outer shell and substantially filling the cavity, wherein said inner matrix is configured to undertake a portion of the forces exerted by the fluid and comprises:

a series of nodes;

a series of substantially spherical voids positioned to contact one another and wherein each substantially spherical void is located between eight nodes arranged in a substantially rectangular pattern, and a series of apertures located at the points of contact between said substantially spherical voids, wherein said apertures provide a pathway for the fluid to travel between said adjacent substantially spherical voids, wherein said apertures are smoothed and filleted in a convex shape; and an inlet/outlet device configured to selectively permit the introduction and removal of the fluid, wherein said inlet/outlet device comprises:

a passageway extending from the outer shell, a coupler, a cap located between the passageway and the outer shell, and a series of holes that pass through the cap.

2. The pressure vessel apparatus of claim 1 wherein:

the outer shell and the inner matrix are integrally formed.

3. The pressure vessel apparatus of claim 1 wherein:

the substantially spherical voids are arranged in a simple cubic arrangement.

4. The pressure vessel apparatus of claim 1 wherein:

the substantially spherical voids are arranged in a body centered cubic arrangement.

5. The pressure vessel apparatus of claim 1 wherein:

the substantially spherical voids are arranged in a face centered cubic arrangement.

6. The pressure vessel apparatus of claim 1 wherein:

the inner matrix is configured to absorb a majority of the forces exerted by the fluid.

7. The pressure vessel apparatus of claim 1 wherein:

the inner matrix is configured to absorb substantially all of the forces exerted by the fluid.

8. The pressure vessel apparatus of claim 1 wherein:

said coupler comprises a series of threads located in said passageway; and said holes are located so as to not interfere with said inner matrix.

9. The pressure vessel apparatus of claim 1 further comprising:

a second inlet/outlet device, wherein the inlet/outlet device and the second inlet/outlet device are configured to facilitate washing of the cavity.

10. A pressure vessel apparatus for containing a fluid under pressure comprising:

an outer shell which defines a cavity and is configured to contain the fluid;

a series of interconnected nodes defined by:

a series of substantially spherical voids located so as to contact one another at a series of points of contact, and a series of apertures having edges filleted in a convex shape and located at the points of contact such that fluid may flow between adjacent substantially spherical voids; and an inlet/outlet device configured to selectively permit the introduction and removal of the fluid from the cavity;

wherein said series of interconnected nodes are configured to absorb a majority of the forces exerted by the fluid.

11. The apparatus of claim 10 wherein:

each substantially spherical void is located between eight nodes arranged in a substantially rectangular pattern.

12. The apparatus of claim 10 wherein:

said series of interconnected nodes are configured to absorb substantially all of the forces exerted by the fluid.

13. The apparatus of claim 10 wherein:

said series of interconnected nodes substantially fill the cavity.

14. The apparatus of claim 10 further comprising:

a passageway extending from the outer shell and having a series of threads therein.

15. The apparatus of claim 14 further comprising:

a cap located between the passageway and the outer shell; and a series of holes that pass through the cap.

16. The apparatus of claim 10 wherein:

said series of interconnected nodes are integrally formed with said outer shell.

17. The apparatus of claim 16 wherein:

said series of interconnected nodes are integrally formed with said outer shell using 3-D printing.

18. A pressure vessel apparatus for containing a fluid under pressure comprising:

an outer shell which defines a cavity and is configured to contain the fluid;

an inner matrix substantially filling the cavity and configured to undertake a majority of the forces exerted by the fluid, wherein said inner matrix comprises:

a series of interconnected substantially cylindrical members, and a series of nodes formed by the intersection of said substantially cylindrical members, wherein the edges of said substantially cylindrical members located between said nodes are filleted into a substantially concave shape; and an inlet/outlet device configured to selectively permit the introduction and removal of the fluid to and from the cavity.

19. The apparatus of claim 18 further comprising:

a series of voids located between said nodes, wherein said voids are substantially spherical in shape and permit the flow of the fluid between said series of voids.

20. The apparatus of claim 18 wherein:

said series of interconnected nodes are formed by the intersection of three substantially cylindrical members; and said series of interconnected nodes are subject to substantially tri-axial loading conditions.

* * * * *